United States Patent [19]

Kimura

[11] 4,210,053

[45] Jul. 1, 1980

[54] ELECTRONIC MUSICAL INSTRUMENT

[75] Inventor: Takeji Kimura, Toyonaka, Japan

[73] Assignee: Matsushita Electric Industrial Co., Ltd., Osaka, Japan

[21] Appl. No.: 35,900

[22] Filed: May 3, 1979

[30] Foreign Application Priority Data

May 4, 1978 [JP] Japan ..... 53-53331

[51] Int. Cl.[2] ..... G10H 1/00

[52] U.S. Cl. ..... 84/1.01; 84/1.26

[58] Field of Search ..... 84/1.01, 1.26, DIG. 8; 340/365 C

[56] References Cited

U.S. PATENT DOCUMENTS

| | | | |
|---|---|---|---|
| 3,614,287 | 10/1971 | Klann | 84/1.01 |
| 3,668,659 | 6/1972 | Hutchings | 340/365 C |
| 3,872,764 | 3/1975 | Munch, Jr. et al. | 84/1.01 |
| 3,902,397 | 9/1975 | Morez et al. | 84/1.01 |
| 3,924,505 | 12/1975 | Schrecongost | 84/1.01 |
| 4,028,979 | 6/1977 | Luce | 84/1.01 |
| 4,041,826 | 8/1977 | Oya | 84/1.01 |
| 4,077,293 | 3/1978 | Uchiyama | 84/1.01 |
| 4,085,647 | 4/1978 | Adachi | 84/1.01 |
| 4,121,348 | 10/1978 | Niinomi et al. | 84/1.01 |
| 4,148,017 | 4/1979 | Tomisawa | 84/1.01 |

*Primary Examiner*—J. V. Truhe
*Assistant Examiner*—Forester W. Isen
*Attorney, Agent, or Firm*—Wenderoth, Lind & Ponack

[57] ABSTRACT

An electronic musical instrument of a type in which information of actuation of keys is detected by scanning the keys of keyboard. The electronic musical instrument includes the keys selectively actuable for producing sounds which correspond to respective musical scale notes, circuitry for sequentially scanning said keys for detection of the information of the actuation of said keys, and memorizing circuitry which corresponds to each of the keys so that the information of the actuation of the keys is memorized. Each memorizing circuitry is composed of a pair of capacitors, one of which is a small capacitor for "dynamic" holding, and the other of which is a capacitor for determination of decay envelope, with the latter being sequentially connected electrically to the former.

8 Claims, 5 Drawing Figures

ELECTRONIC MUSICAL INSTRUMENT

BACKGROUND OF THE INVENTION

The present invention relates to electronic musical instruments and more particularly, to electronic musical instruments such as electronic organs, electronic pianos, electronic accordions and the like based on a system wherein information of actuation of keys is detected by scanning the keys of a keyboard.

Conventionally, as a superior system for detecting information of actuation of keys and for memorizing and holding the information by extremely simple circuitry, there has been proposed an arrangement by the present inventor and others, for example, in Japanese Laid Open Patent Application Tokkaisho No. 52/143010, in which there is disclosed an electronic musical instrument which employs an extremely simple circuit stable for formation into a large scale integrated circuit (referred to as LSI hereinbelow) by arranging to "dynamically" memorize and hold the information of actuation of the keys in electrical capacity or capacitance corresponding to each of the keys. In the known arrangement as described above, the gate capacity of MOS (metal-oxide-semiconductor) type transistor is employed for the electrical capacitance, but in the system wherein variation in the envelope of musical note or tone is involved as in "sustain" function, sufficient time constant (normally required up to 1 to 3 seconds) is not available, and thus, it has been necessary to set the respective capacitances to considerably large values. Accordingly, incorporating or integrating the capacitances of large values as described above into the same chip together with other constituting elements (for example, the portion equivalent to FIG. 1 of Japanese Laid Open Patent Application Tokkaisho No 52/143010 mentioned earlier) results in a marked increase of area of the chip, with consequent high cost and reduction of yield in manufacturing to a large extent, thus not being suited to practical application. Furthermore, if it is intended to simultaneously use the same LSI for a musical instrument accompanied by the envelope variations as in "sustain" function and also for a musical instrument not accompanied by the envelope variations (i.e., musical instrument without the "sustain" function, etc.,) considerably wasteful portion not directly related to the intended functions is undesirably involved within the LSI, especially in the latter system not accompanied by the envelope variations, thus also presenting problems in the practical application.

SUMMARY OF THE INVENTION

Accordingly, an essential object of the present invention is to provide an electronic musical instrument of keyboard scanning type having circuit construction suited to integration into one chip, with information of actuation of the keys being adapted to be memorized and held by extremely simple circuit arrangement.

Another important object of the present invention is to provide an electronic musical instrument of the above described type in which deviations in characteristic values, leakage currents, etc. of a plurality of electrical capacitances employed therein do not directly effect deviations of time constant of "sustain" function and the like.

A further object of the present invention is to provide an electronic musical instrument of the above described type in which envelope forming function such as "sustain" function is incorporated into separate chip for attaching as discrete element to LSI in the main unit depending on necessity.

A still further object of the present invention is to provide an electronic musical instrument of the above described type which is accurate and stable in functioning with a high reliability, and can be readily manufactured at comparatively low cost.

In accomplishing these and other objects, according to one preferred embodiment of the present invention, the electronic musical instrument of a type in which information of actuation of keys is detected by scanning of switch blocks for the keys so as to memorize and hold the information of actuation of the keys in electrical capacitances for developing as output, musical tones corresponding to the memorized information of actuation of the keys includes a first group of the electrical capacitances which hold analog values corresponding to amplitudes of musical tones during the scanning period of the switch blocks for the keys, and a second group of the electrical capacitances which memorize the analog values for period sufficiently longer than the scanning period of the switch blocks of the keys after releasing of depression of the keys so as to control envelope by the second group of the electrical capacitances.

By the arrangement of the present invention as described above, the electronic musical instrument having circuit construction suitable for integration into one chip in which deviations in the time for "sustain" function and the like are removed has been advantageously presented, with substantial elimination of disadvantages inherent in the conventional musical instruments of the kind.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
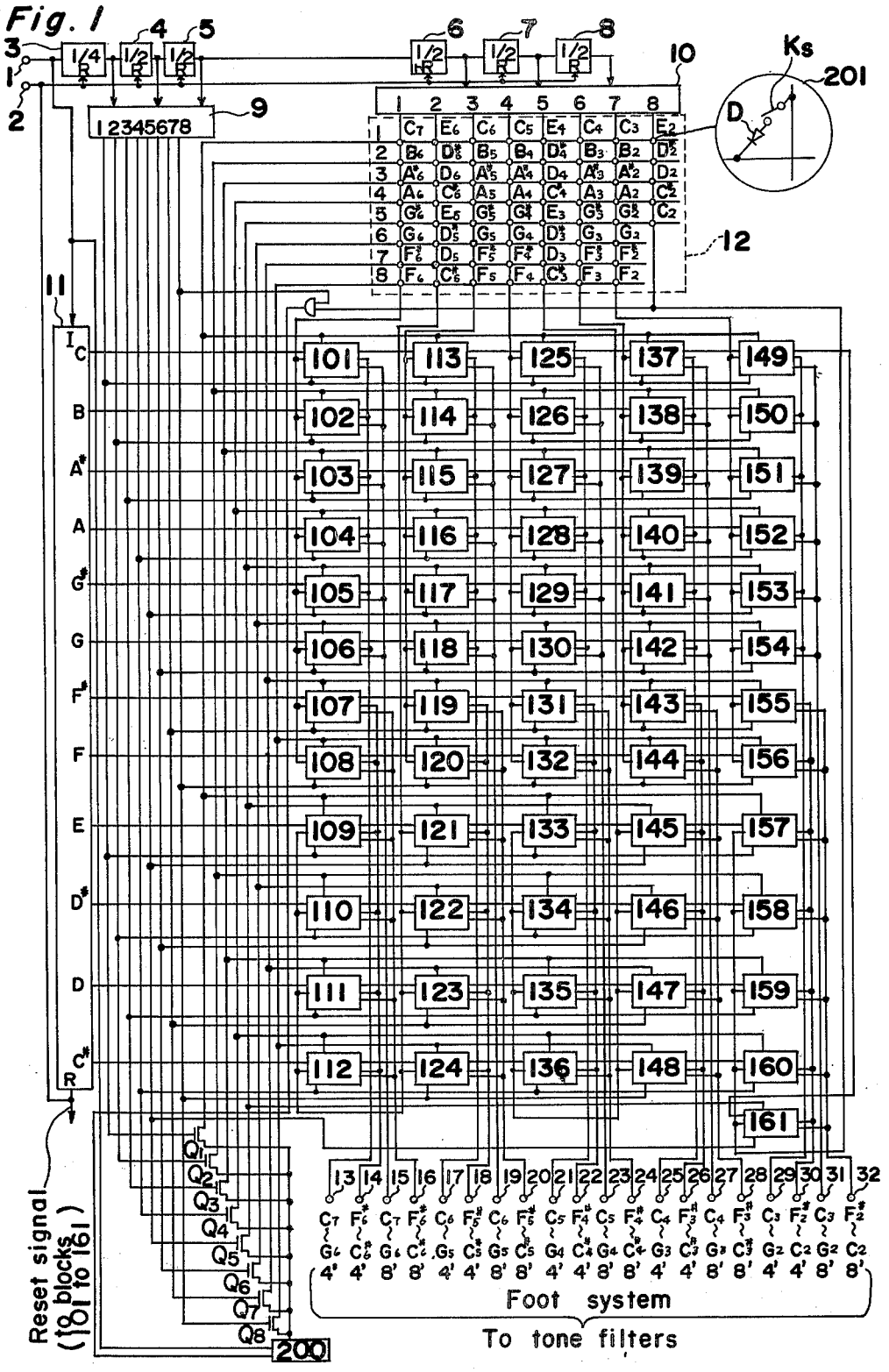
FIG. 1 is a schematic block diagram of tone generator and keying circuits of an electronic organ according to one preferred embodiment of the present invention.
Figure 2:
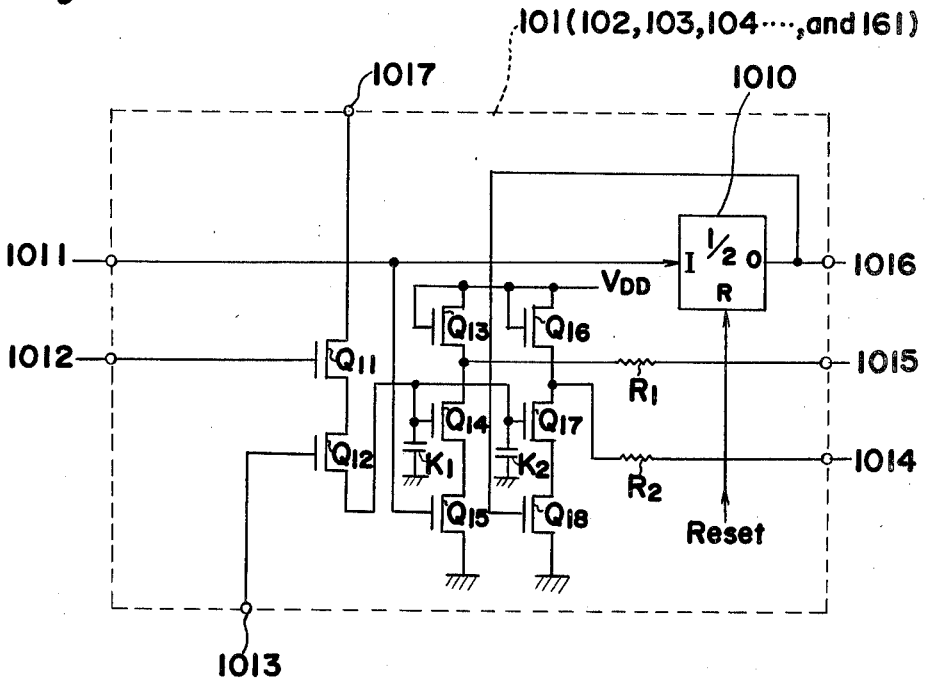
FIGS. 2 and 3 are schematic diagrams showing examples of circuit constructions in the blocks employed in the arrangement of FIG. 1.
Figure 3:
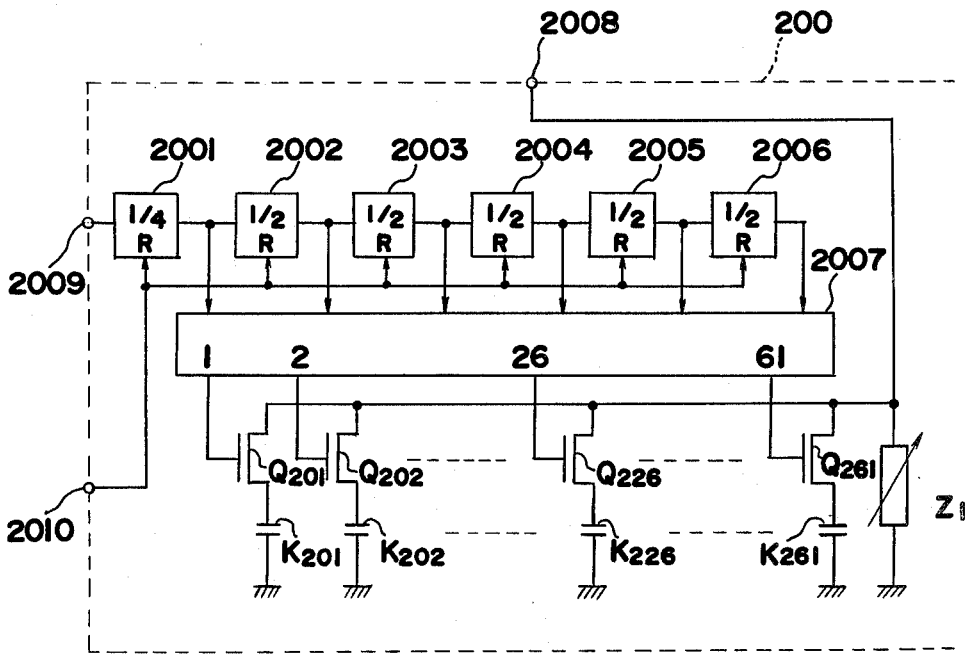

Referring now to the drawings, there are shown in FIG. 1 keying and tone generator sections of an electronic organ according to one preferred embodiment of the present invention, while FIG. 2 shows the construction of each of reset blocks 101, 102, 103, . . . and 161 of FIG. 1, and FIG. 3 illustrates the construction of a block 200 employed in the arrangement of FIG. 1. In FIG. 1, clock pulses are applied to an input terminal 1 from an output terminal of a clock source (not shown) having frequency, for example, of approximately 2

MHz, while reset signals for frequency dividers 3, 4, 5, 6, 7 and 8 are applied to an input terminal 2 for the reset signals. The ¼ frequency divider 3 is constituted, for example, by connecting two ½ frequency dividers in series to each other, while each of the other frequency dividers 4 to 8 is a ½ divider adapted to successively divide the output from the ¼ frequency divider 3. A decoder 9 of three bits is coupled to the ¼ divider, 3, ½ divider 4 and ½ divider 5 for decoding the outputs from the latter to develop eight progressive pulses. Similarly, a decoder 10 of three bits coupled to the ½ dividers 6, 7 and 8 is adapted to decode the outputs of the latter and develop eight progressive pulses. A top octave divider 11 connected to the terminal 1 develops a signal of approximately the highest octave of the note by independently dividing each of the input signals from the input terminal 1. Meanwhile, a keyboard switch 12 inserted between the decoder 10 and the circuit blocks 101, 102, 103, . . . and 161 has sixty-one keys C7, B6, A#6, A6, G#6, G6, . . . and C2 arranged in positions corresponding to junctions of matrix, while, to each of the junctions, a circuit 201 of series-connected keyboard switch Ks and diode D are connected as shown by way of example in a circle at the upper right of FIG. 1. A group of output terminals 13, 14, 15, . . . and 32 to be connected to tone filters (not shown) produces output signals each having six notes arranged therein.

The gates of transistors Q1, Q2, Q3, Q4, Q5, Q6, Q7 and Q8, for example, of MOS field effect type are respectively connected to output terminals 1, 2, 3, 4, 5, 6, 7 and 8 of the decoder 9, while the drains of the transistors Q1 to Q8 are coupled to output terminals 1 to 8 of the keyboard switch block 12. Furthermore, the sources of the transistors Q1 to Q8 commonly connected to each other are coupled to the block 200. Each of the circuit blocks 101, 102, 103, . . . and 161 includes a ½ frequency divider 1010 coupled to transistors Q11, Q12, Q13, Q14, Q15, Q16, Q17 and Q18, resistors R1 and R2, and capacitors K1 and K2 as shown in FIG. 2, while the circuit block 200 includes a ¼ frequency divider 2001, a group of ½ frequency dividers 2002, 2003, 2004, 2005 and 2006, a 6 bit decoder 2007, transistors Q201, Q202, Q203 . . . and Q261, capacitors K201, K202, K203, . . . and K261, and a variable impedance element Z1 coupled to each other in a manner as illustrated in FIG. 3.

By the above arrangement, functions of the tone generator and keying circuits are described hereinbelow.

From the source signal applied to the input terminal 1, there are produced signals having twelve kinds of frequencies in which four-foot group fundamental frequencies of twelve notes of the keys C7 to C#6, i.e., frequencies ranging from approximately 4,186 Hz to 2,218 Hz are divided by the top octave divider 11 to have a ratio of about $12\sqrt{2}$, which signals are respectively supplied to terminals 1011 (FIG. 2) of the circuit blocks 101, 102, 103, . . . and 112. The signal thus applied to the terminal 1011 is divided to half the ½ frequency divider 1010 to be output from it terminal 1016 and is further applied to an input terminal 1011 of the subsequent block. Meanwhile, output from the terminal 1016 of the block 149 is input to the terminal 1011 of the block 161. By the connections as described above, the circuit blocks 101, 102, . . . and 112 correspond to the tones or notes of the keys C7, B6, A#6, . . . and C#5, with each of the input terminals 1011 having frequency of four-foot group and each of the output terminals 1016 having frequency of eight-foot group. Similarly, the blocks 113, 114, . . . and 124 correspond to the tones of the keys C6, . . . and C#3, the blocks 149, 150, . . . and 160 to the tones of the keys C3, . . . and C#2, and the block 161 to the tone of the key C2 respectively, with the signal of the input terminal 1011 of each block being of frequency of four-foot group and that of the output terminal 1016 being of frequency of eight-foot group. In each of the blocks 101, 102, . . . and 161, the input terminal 1011 is connected to the gate of the input transistor Q15 which is one of the first AND gate including the transistors Q13 to Q15, while the output terminal 1016 is connected to the gate of the input transistor Q18 which is one of the second AND gate including the transistors Q16 to Q18.

Subsequent to the foregoing description related to the tone source signal frequency dividing section, functions of the keyboard scanning section will be described hereinbelow.

The source signal applied to the terminal 1 is demultiplied to frequency easy to handle by the ¼ frequency divider 3 and is further supplied to the ½ frequency dividers 4 and 5. The outputs from the frequency dividers 3, 4 and 5 are input to the decoder 9 of three bits for developing eight kinds of progressive pulses therefrom. Of the outputs from the decoder 9, the first output is coupled to the blocks 101, 113, 125, 137 and 149 of C note system and to a terminal 1013 of each of the blocks 109, 133 and 157 of the E note system for driving the transistor Q12 of each of the blocks. The transistor Q12 constitutes a transfer gate together with the transistor Q11, and when the transistors Q11 and Q12 are both turned ON, the signal of a terminal 1017 is transmitted to the gates of the transistors Q14 and Q17, while upon turning OFF of either of the transistors Q11 and Q12, the gate potentials of the transistors Q11 and Q12 are retained at the gate capacities K1 and K2. On the other hand, of the outputs from the decoder 9, the second output is coupled to the terminals 1013 for the three blocks 110, 134 and 158 of D# note system and all the blocks 102, 114, 126, 138 and 150 in the B note system. Since subsequent connections are in the similar manner to the above, description thereof is abbreviated for brevity. Meanwhile, the output from the ½ frequency divider 5 is further supplied to the series-connected three ½ frequency dividers 6, 7 and 8, the outputs of which are input to the decoder 10 of three bits for developing eight kinds of progressive pulses from the decoder 10, while the output progressive pulses of the decoder 9 are successively shifted from one to the next. The eight outputs from the decoder 10 constitute the ordinate of the keyboard matrix 12, and are simultaneously fed to terminals 1012 of the blocks 101, 102, . . . and 161. More specifically, of the outputs from the decoder 10, the first output is fed to the blocks 101 to 108, the second output to the blocks 109 to 112 and also to the blocks 121 to 124, the third output to the blocks 113 to 120, the fourth output to the blocks 125 to 132, the fifth output to the blocks 133 to 136 and to the blocks 145 to 148, the sixth output to the blocks 137 to 144, the seventh output to the blocks 149 to 156, and the eighth output to the blocks 157 to 161, thus driving the transistor Q11 used as the transfer gate through respective terminals 1012. On the other hand, the abscissa of the keyboard matrix 12 is connected to the input terminals 1017 for the blocks 101 to 161, with the first abscissa being coupled to the blocks to which the first output is connected, i.e., to the blocks 101, 113, 125, 137, 149, 109 and 133 and also to the block 157, while the second to the eighth abscissa are connected to the terminals 1017 of the blocks to which outputs having the numbers corresponding to the second to the eighth outputs of the decoder 9 are coupled.

Still referring to FIGS. 1 and 2, functions upon depression of the keys of the keyboard are described hereinbelow.

On the assumption that a given key of the keyboard, for example, the key B4 is depressed, the fourth output of the outputs from the decoder 10 is connected through a diode to the second abscissa of the keyboard matrix. When the output progressive pulses of the decoder 10 are developed at the fourth output, i.e., when the fourth output is at high level, the terminals 1012 of the blocks 125 to 132 are rendered to be high, with the transistors Q11 for these blocks being turned ON. Meanwhile, the second abscissa for the keyboard matrix is rendered to be "high" through the switch B4, and thus the terminals 1017 for the blocks 102, 114, 126, 138, 150, 110 and 134 and also for the block 158 are brought to "high" state. Under such a condition, the eight outputs of the decoder 9 are successively rendered to be "high", and only when the seond output is brought to "high" state, the terminals 1013 for the blocks 102, 114, 126, 138, 150, 110, 134 and 158 are rendered to be "high". Consequently, only the block 126 has the transistors Q11 and Q12 both turned ON, with the information of the terminal 1017, i.e., "high" being read into the gates of the transistors Q14 and Q17 for charging up the capacitances K1 and K2 to "high". It should be noted here that the capacitances K1 and K2 are of gate capacity formed between the gates of the MOS transistors Q14 and Q17 and a substrate (not shown). When the gate of the transistor Q14 is rendered to be "high", another input for the NAND circuit constituted by the transistors Q13, Q14 and Q15, i.e., the gate signal of the transistors Q15 is inverted to be developed at the output. In other words, inversion of the input signal to the ½ frequency divider 1010 is fed to the resistor R1 and is further developed at an output terminal 1015. Similarly, by bringing the gate of the transistor Q17 to the "high" state, inverted signal of the output signal of the ½ frequency divider 1010 by the NAND gate including the transistors Q16, Q17 and Q18 is fed to the resistor R2, and is further developed as output at the output terminal 1014. The outputs from the output terminals 1014 and 1015 are respectively arranged into six notes (seven notes only at bass tone side of the minimum octave) of the same octave to be coupled to terminals 23 and 21 of the terminal group, while the signals from the terminals 23 and 21 are developed as outputs for the musical instrument from speakers (not shown) through the tone filters and amplifiers (both not shown). More specifically, the terminal 23 is of the output of the eight-foot group of the keys C5 to G4, while the terminal 21 is of the output of four-foot group of the keys C5 to G4, and such outputs are produced in the form subjected to resistance mixing.

Referring particularly to FIG. 3, the function of the block 200 employed in the arrangement of FIG. 1 will subsequently be described. The ¼ frequency divider 2001 and the group of ½ frequency divider 2002, 2003, 2004, 2005 and 2006 are each reset by the signal applied to the terminal 2010. To the terminal 2010 of the block 200, AND signals from the output 8 of the block 9 and output 8 of the block 10 are coupled, by which arrangement, the frequency dividers 3 to 8 and 2001 and 2006 are perfectly aligned in phase. Therefore, the transistors Q201 to Q261 and capacitors K201 to K261 respectively correspond to the blocks 101 to 161 in the relation of one to one, with the transistor Q201 and capacitor K201 corresponding to the block 101, and the transistor Q202 and capacitor K202, to the block 102 and so on.

In the above arrangement, in the state where the key B4 is depressed and the block 126 corresponding to the key B4 is scanned, the transistor Q226 and capacitor K226 corresponding to the block 126 are selected, with the transistor Q226 being turned ON and capacitor K226 being connected to the terminal 2008 and variable impedance element Z1. Accordingly, the capacitor K226 is connected to the sources of the transistors Q1 to Q8. Meanwhile, since the terminal 2 of the block 9 is in "high" state and the terminal 2 of the block 12 is also in "high" state, the transistor Q2 of the transistors Q1 to Q8 is in the "ON" state, and thus, the capacitor K226 is charged up to "high" state. It is to be noted that, in the above state, the terminals 1 and 3 to 8 of the block 9 are in "low" state, and therefore, the transistors Q1 and Q3 to Q8 are turned OFF, with the drains of the transistors Q1 and Q3 to Q8 being cut off from the capacitor K226. On the other hand, the "high" level of the terminal 2 of the block 12 is connected to the ground potential via the transistor Q2 through the variable impedance element Z1, and therefore, current corresponding to the impedance value of the variable impedance element Z1 is flowing therethrough. The current flowing through the variable impedance element Z1 in the above state where the key B4 is depressed is "wasteful" current in a sense, and a system for eliminating such "wasteful" current may readily be constituted, but description thereof is abbreviated here for brevity since such a system is not an item essential to the present invention.

Subsequent to the state as described in the foregoing where the key B4 is depressed and the block 126 corresponding to the key B4 is scanned, the blocks that follow are sequentially scanned, and during this period, the transistors Q11 and Q12 of the block 126 are never turned OFF simultaneously, and therefore, the signal of the terminal 1017 is not transmitted to the gates of the transistors Q14 and Q17. Similarly, the transistor Q226 is never turned ON. Accordingly, the gate potential of the transistors Q14 and Q17 is kept in the state where the block is scanned by the charge held in the capacitors K1 and K2. In the similar manner, the charge accumulated in the capacitor K226 remains unchanged. Although there exists a certain amount of voltage drop due to leakage current at the source junctions of the transistors Q12 and Q226 in the actual practice, in the MOS transistors produced through normal processes, "high" level of approximately 10 m sec. can fully be maintained without particular addition of capacity for the capacitors K1 and K2. Therefore, if each of the blocks is scanned at a cycle shorter than the above holding time, the information of actuation of the keys is "dynamically" held in the blocks. In the embodiment of the present invention, the input signal of about 2 MHz to the terminal 1 is divided to ¼ by the ¼ frequency divider 3, and further to 1/32 by the ½ frequency dividers 4, 5, 6, 7 and 8, and therefore, the repeating frequency for scanning the blocks is approximately 15.6 KHz, with the cycle for scanning of about 64$\mu$ sec., which is sufficiently shorter than the "dynamic" holding time mentioned eralier, thus inviting no particular problems. Furthermore, by setting the repeating frequency for the scanning to the range outside the audio range or to the range outside the tones used in the electronic organ as described above, with further removal thereof through a filter, influence on the tones by the variations of the gate output amplitude following the charging and discharging of the hold charge can be advantageously eliminated.

Subsequently, functions after the key B4 has been released from the depressed state will be described hereinbelow. In the state where the switch for the key B4 is opened, with consequent scanning of the block 126, even when the terminal 4 of the block 10 is rendered to be "high", the "high" signal is not applied to the terminal 2 of the block 12. However, since "high" state is held in the capacitor K226 and the transistor Q226 is turned ON at this timing, the "high" state is applied to the sources of the transistors Q1 to Q8 from the terminal 2008. In the above state, only the transistor Q2 of the transistors Q1 to Q8 is in the ON state, and therefore, the voltage is fed to the terminal 1017 of the block 126 to keep the transistors Q14 and Q17 turned ON. However, since the change of the capacitor K226 is simultaneously discharged through the variable impedance element Z1, the potential across the capacitor K226 is gradually decreased, with consequent decrease of the gate potential for the transistors Q14 and Q17.

In the functions under the state where the key B4 and block 126 are being scanned as described in the foregoing, when the scanning is transferred onto other keys, the transistor Q226 is turned OFF, and the discharging of the capacitor K226 through the variable impedance element Z1 is interrupted to hold the accumulated charge at this time point. After completion of one cycle of the keyboard scanning for the 61 keys, when the same key B4 is again brought into the scanning state, the charge of the capacitor K226 again continues to be discharged through the variable impedance element Z1, with the potential across the capacitor K226 being applied to the gates of the transistors Q14 and Q17 of the block 126. In the manner as described, the gate potential of the transistors Q14 and Q17 is gradually decreased with time, while the "ON" resistance of the transistors Q14 and Q17 being increased. Accordingly, in the "ON" resistance ratios of the transistors Q13 and Q14, and of the transistors Q16 and Q17, the resistances of the transistors Q14 and Q17 are increased with time and more strictly, at every time the key B4 is scanned, and thus, the amplitude of the signals developed at terminals 1014 and 1015 (FIG. 2) are gradually descreased to perform the so-called "sustain" function. More specifically, since the discharging takes place only when the key B4 is scanned, the amplitude is reduced discontinuously in the strict sense, but such discontinuity presents no problems at all in the foregoing embodiment of the present invention in which the scanning period is on the order of 64$\mu$ sec., providing natural attentuating sound to the sense of hearing.

In the embodiment of the present invention as described in the foregoing, the duty ratio for one key to be scanned is 1/64, and therefore, the discharging time constant thereof is consequently prolonged. For example, when a variable resistance is employed for the variable impedance element Z1, the value 64 times that of the time constant determined by the product of the values of the capacitor K226 and variable impedance element Z1 becomes the time constant for the "sustain" function of the system according to the foregoing embodiment of the present invention. Conversely, the capacity value of the capacitor K226 may be reduced by that extent, which arrangement is advantageous, for example, in the case where the capacitors K201 to K261 are formed into integrated circuit in the same one chip. Functions similar to the foregoing are also achieved when the keys other than B4 are depressed, and if the capacity values of the capacitors K201 to K261 are preliminarily aligned with each other, it is possible to cause all the keys to equally perform "sustain" function by the time constant determined by the set value of the variable impedance element Z1. Furthermore, if the variable impedance element whose voltage and current characteristics show a trend which is convex downward, for example, one disclosed in Japanese Laid Open Patent Application Tokkaisho No. 50/100846 is employed as the variable impedance element instead of the variable resistance, attenuating envelope closer to natural musical instruments can be achieved.

Although, in the foregoing, description is mainly directed to the case where one of the keys is depressed, it is readily understood from FIGS. 1, 2 and 3 that even when more than two keys are depressed simultaneously, retaining or holding of the information of the actuation of the keys and opening and closing of the notes are respectively effected independently for each of the keys in the similar manner as in the key B4 as described earlier.

The circuit construction as described above has such advantages that since the same discharge element is used for all the keys, deviation of the sustaining time due to difference in characteristics in a plurality of discharge elements employed can be eliminated, while by altering voltage and current characteristics of the variable impedance element Z1 for discharge, not only the sustaining time, but the configuration of the envelope can be readily controlled.

As is understood from the foregoing description, for providing the sustaining function through gradual discharge of the electrical charge accumulated in the capacitors K201 to K261 (FIG. 3), the gates including the transistors Q13, Q14 and Q15, and Q16, Q17 and Q18 should be of analog gate respectively. By setting threshold voltage value and mutual conductance value, for example, of the transistors Q13, Q14 and Q15 to approximately equal to each other, the gate including the transistors Q13 to Q15 as well as that including the transistors Q16 to Q18 form the analog gate suitable for the purpose.

The arrangement in the embodiment of FIGS. 1 to 3 wherein rectangular waves of the repeating frequency corresponding to pitches of the eight-foot group or four-foot group of respective notes are led to the output through the gate including the transistors Q13 to Q15 or Q16 to Q18 may be so modified as to produce other waveforms such as stepped waves by mixing the signals of higher octave in analog form at a proper ratio. For example, although the tones of eight-foot group are described, in the circuit of FIG. 2, as obtained by connecting and disconnecting the output of the ½ frequency divider 1010 at the gate including the transistors Q16 to Q18 for producing output at the output terminal 1015 through the resistor R2, the arrangement may be modified in such a manner that the output of the ½ divider 1010 is also connected and disconnected by another gate having components similar to the transistors Q16 to Q18 and is further connected to the output terminal 1015 through a resistor having a value twice as large as that of the resistor R2 for addition by ½ times of rectangular waves having repeating frequency twice as large, and thus the stepped wave output having two steps can be obtained. Similarly, by addition of rectangular waves of still higher octave at the rate ¼ times, ⅛ times, ect., stepped waves of four steps, eight steps, and so on may be obtained to produce tone source signals rich in tone component multiplied by even numbers. In the above case, the number of frequency dividing stages for octave may be increased depending on the necessity, with corresponding increase of the frequency of the source signals.

Additionally, in the embodiment of FIGS. 1 to 3, since the progressive pulses developed at the output terminals 1, 2, 3, 4, 5, 6, 7 and 8 of the decoder 9 are so arranged as to be output in contact with each other on time axis, malfunction may result, if there exists time lag due to propagation delay in the frequency dividers 3, 4, 5, 6, 7 and 8, wiring arrangement in the keyboard matrix 12, and the like. Such an inconvenience, however, may readily be eliminated by making the input for the decoder 9 into four bits so as to employ, as the outputs 1, 2, 3, 4, 5, 6, 7 and 8, the eight outputs, i.e., every other output of the sixteen decoder outputs, and by making the input for the decoder 2007 into seven bits with every other output which amounts to sixty-four being selected from the one hundred and twenty-eight outputs so as to employ sixty-one of those as the outputs 1, 2, . . . and 61.

Figure 4:
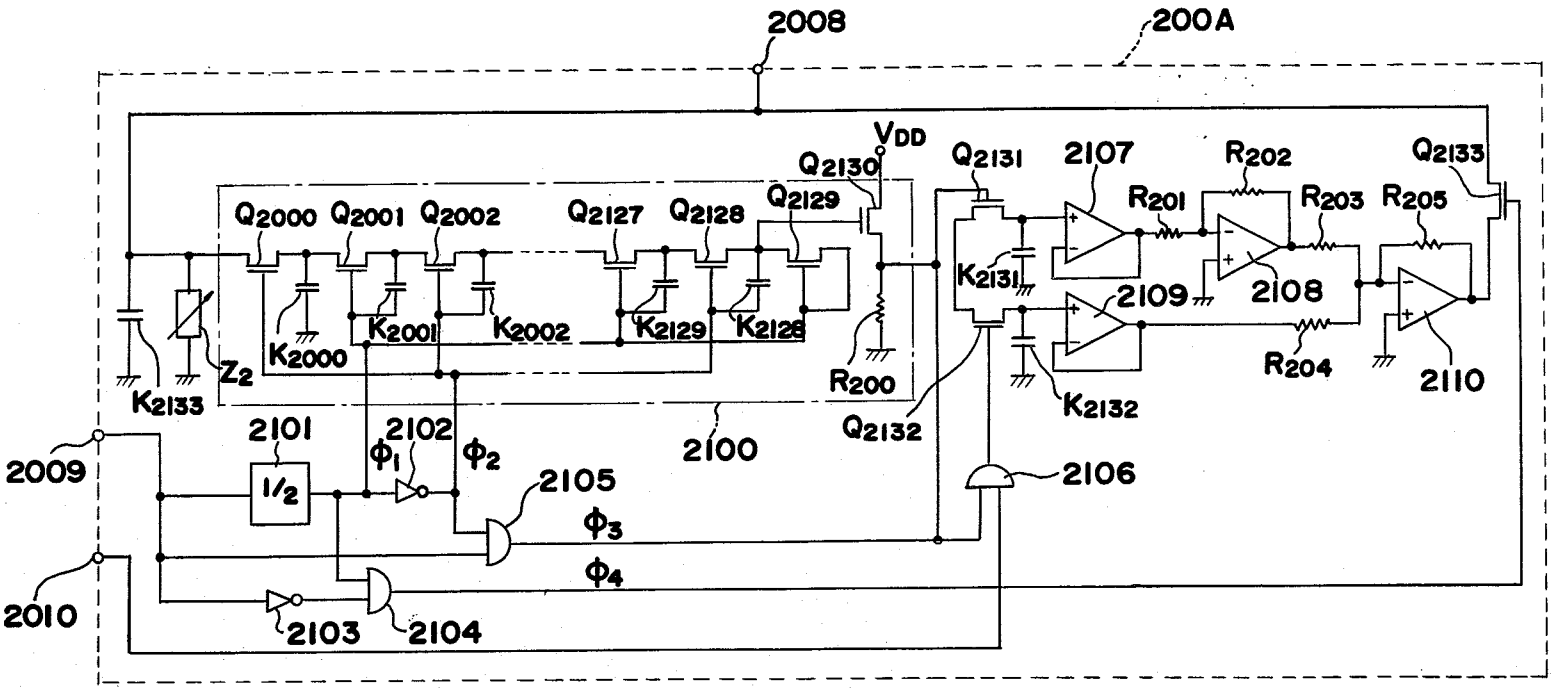
FIG. 4 is a view similar to FIG. 3, which particularly shows a modification of the block of FIG. 3.
Figure 5:
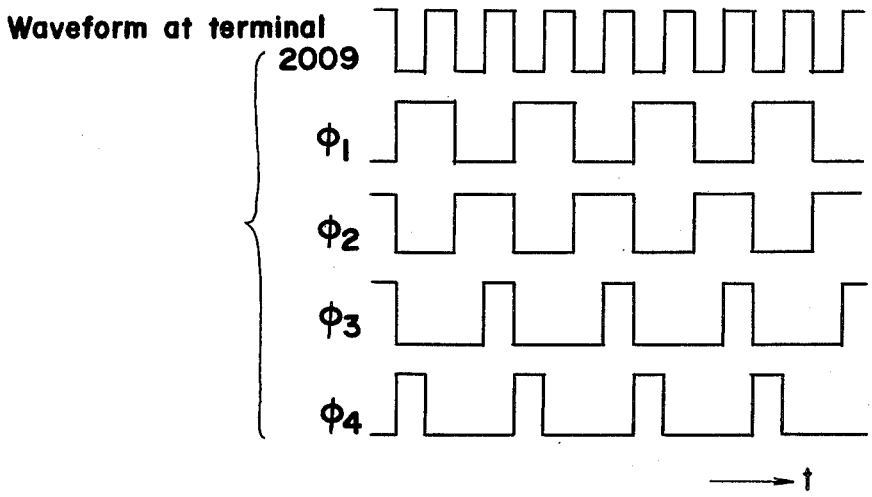
FIG. 5 illustrates waveforms of signals at portion of the circuit of FIG. 4.

Reference is had to FIG. 4 showing a modification of the block 200 of FIG. 3, and also to FIG. 5 schematically showing waveforms at main portions of the modified block of FIG. 4, in which the terminals 2008, 2009 and 2010 correspond to the terminals having the like numerals in FIG. 3.

In FIG. 4, the portion 2100 surrounded by chain lines is a bucket bridgade device (referred to as BBD hereinbelow), which is of one hundred and twenty-eight stage construction including an input transistor Q2000, an input capacitor K2000, transfer transistors Q2001 to Q2128, transfer capacitors K2001 to K2128, a terminal transistor Q2129, an output transistor Q2130, and a load resistance R200 connected to each other as shown, and is arranged to be driven by two phase clocks $\phi 1$ and $\phi 2$. The modified block 200A of FIG. 4 further includes a ½ frequency divider 2101, inverters 2102 and 2103, AND gates 2104 to 2106 of two inputs and operational amplifiers 2107 to 2110. In FIG. 4, a transistor Q2131 and a capacitor K2131, a transistor Q2132 and a capacitor K2132, and a transistor Q2133 and a capacitor K2133 respectively constitute sample hold circuits, with only the capacitor K2133 being shunted by the variable impedance element Z2 for the discharging. It is to be noted that the capacitor K2133 is set to have a capacity value sufficiently large as compared with the input capacitor K2000 within the BBD2100. Resistors R201 and R202 and the operational amplifier 2108 constitute a polarity inversion circuit, with the resistance values of the resistors R201 and R202 being set to be equal to each other. Meanwhile, resistors R203, R204 and R205 form an analog addition (and polarity inversion) circuit together with the operational amplifier 2110, with the resistance values of the resistors R203, R204 and R205 being set to be equal to each other.

Subsequently, functions of the circuit of FIG. 4 will be described with reference to FIG. 5.

To the terminal 2009 in FIG. 4, the same input as that for the terminal 1 of FIG. 1 is impressed so as to be divided by the ½ frequency divider 2101 to form the clock $\phi 1$, which is further inverted by the inverter 2102 for the formation of the clock $\phi 2$. The clocks $\phi 1$ and $\phi 2$ thus formed drive the BBD2100, and are simultaneously supplied to the AND gates 2104 and 2105. At the AND gate 2105, sampling pulse $\phi 3$ which becomes "high" only at the timing of the latter half of the "high" level of the clock $\phi 2$ is produced by taking AND of the signal of the terminal 2009 and the clock $\phi 2$, while at the AND gate 2104, sampling pulse $\phi 4$ which becomes "high" only at the timing of the first half of the "high" level of the clock $\phi 1$ is generated by taking AND of the output of the inverter 2103 obtained through inversion of the signal of the terminal 2009 and clock $\phi 1$.

Meanwhile, at the AND gate 2106, only pulse once per sixty-four times of the sampling pulse $\phi 3$, i.e. only pulse at the timing in which the point corresponding to the intersection (no key is disposed at this intersection) of the output 8 of the block 10 and output 8 of the block 12 is scanned is developed to be fed to the gate of the sampling transistor Q2132. The BBD2100 of one hundred and twenty-eight stages sequentially transfers by the clocks $\phi 1$ and $\phi 2$, sixty-four kinds of analog signals to by successively fed out to the output terminal. Since the BBD2100 develops output through the source follower of the transistor Q2130, DC shift equivalent to voltage-component obtained by addition of two times the threshold voltage of the MOS transistor to the amplitude value of the clock is present between the input and output signals, and its value, which varies due to variations of ambient temperatures, is arranged to be corrected in the circuit subsequent thereto. More specifically, by the transistor Q2132 and capacitor K2132, output voltage at the timing corresponding to the intersection whereat no key is disposed in the block 2 is extracted for holding so as to obtain the so-called DC shift component (value to be corrected). On the other hand, by the transistor Q2131 and capacitor K2131, sampling is effected at timing corresponding to all intersections for obtaining DC voltage corresponding to each of the keys, the value of which DC voltage is subjected to polarity inversion by the resistors R201 and R202 and the operational amplifier 2108 to be further fed to the inversion addition circuit including resistors 203 to 205 and the operational amplifier 2110. The resistance values of the resistors R203, R204 and R205 are all set to be equal to each other, and signal from which the DC shift component has been eliminated is developed from the operational amplifier 2110. The signal output is impressed to the terminals 2008 and input of the BBD2100, and also to a parallel circuit of the capacitor K2133 and variable impedance element Z2. Accordingly, the capacitor K2133 directly connected to the terminal 2008 is charged or discharged in correspondence to each of the intersections of the block 12 in the similar manner as in the embodiment of FIG. 3. In the above case, the discharge through the variable impedance element Z2 is effected at the duty ratio for the sampling pulse $\phi 4$ of FIG. 5, i.e. at the value of 3/256 obtained through multiplication by ¾ which is the rate for "low" period, besides the duty ratio of 1/64 corresponding to each of the keys. In other words, as compared with the system of FIG. 3, correction of the capacity value of the capacitor K2133 or impedance value of the variable impedance element Z2 by the amount equivalent to the reduction of the discharging time to ¾ is only necessary in the above case. Moreover, if the capacity value of the capacitor K2133 is made sufficiently large as compared with the capacity value of the capacitor K2000, it is possible to make generation of errors negligibly small by the parallel connection of the capacitors K2133 and K2000 upon turning ON of the transistor Q2000 when the clock $\phi 2$ is rendered to be "high". Furthermore, the variable impedance element Z2 may be replaced by a variable resistance, and it is of course possible to employ variable impedance elements having various characteristics as described with reference to FIG. 3.

It should be noted here that the system of FIG. 4, although rather complicated in its circuit construction as compared with that of FIG. 3, has various features as follows.

(1) For the BBD of the block 2100, those commercially available may be employed, without necessity to separately constitute an exclusive circuit for the purpose.

(2) Although, in the system of FIG. 3, deviations in the capacity values between the capacitors K201 to K261 or in the leakage currents directly affect the deviations in the length of time for the "sustain" function, in the system of FIG. 4, all analog values are successively transferred through the same circuit, and therefore, even if there exist deviations in the capacity values between the capacitors K2000 to K2128 or in the leakage currents, these deviations do not give rise to the deviations in the time of the "sustain" function between the keys.

(3) As described in the above item (2), since the leakage currents of the capacitors K2000 to K2128 are averaged, even where there are a few elements having comparatively large leakage currents in the capacitors K2000 to K2128, the system sufficiently serves the purpose for actual use on the whole, and thus, conditions for the wafer process in the manufacturing are consequently alleviated by that extent, with improved yield in the formation thereof into integrated circuit.

It is to be noted that the BBD described as employed in the foregoing arrangement of FIG. 4 may be replaced by other charge transfer elements, and that the arrangement of FIG. 4 may be further modified so as to be strong against malfunctions by making intervals so that the successive pulses developed at the output terminals 1 to 8 of the decoder 9 do not contact each other in terms of the time axis.

As is clear from the foregoing description, in the electronic musical instrument according to the present invention in which opening and closing of corresponding tones and envelope control are effected by memorizing analog amount in the capacitance for memorizing the information of depression of keys, it is so arranged that, during depression of the key, refreshing of the electrical charge of the "dynamic" capacity of the analog gates for effecting the opening and closing of the corresponding notes and envelope control is made through the keyboard matrix at every scanning of the equivalent key, while, in the time period corresponding to the tone attenuating period immediately after releasing of the depression of the key, the charge information stored in the analog memory is successively read out, and simultaneously, by discharging during the scanned period, reading-out is made from the "dynamic" capacity of said analog gates at every scanning in the form of analog signal attenuating with time for effecting the envelope control and for obtaining the attenuating tones. In the arrangement of the present invention as described above, since the envelope forming block 200 for the tones and other circuit portions of the unit are connected by a very small number of wirings (in the foregoing embodiment, the number of wires is approximately three, and is only two, if the connection between the terminal 1 to the terminal 2009 is excluded), these can be formed into blocks such as integrated circuits each accommodated in an independent package for connection thereof for use depending on necessity. Moreover, the envelope forming portion for the tones may be constituted through utilization of the commercially available BBD, and if charge transfer elements such as BBD are employed, the deviation factors in the time for "sustain" function between the keys can be eliminated, with further alleviation of strict requirements for the manufacturing process.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. In an electronic musical instrument of the type in which information of the actuation of keys is detected by scanning switch blocks for the keys so as to memorize and hold said information of actuation of the keys in electrical capacitances for developing output musical tones corresponding to said memorized information of the actuation of the keys, an improvement of said electronic musical instrument which comprises a first group of electrical capacitances which hold analog values corresponding to the amplitudes of musical tones during the scanning period of said switch blocks for the keys, and a second group of electrical capacitances which memorize said analog values for a period sufficiently longer than the scanning period of said switch blocks of the keys after releasing depression of the keys so as to control musical tone envelopes by said second group of the electrical capacitances.

2. An electronic musical instrument as claimed in claim 1, wherein said first group of electrical capacitances are constituted by the gate capacitances of field affect transistors.

3. An electronic musical instrument as claimed in claim 1, wherein said first and second group of electrical capacitances are formed into asingle integrated circuit.

4. An electronic musical instrument as claimed in claim 1, wherein said second group of electrical capacitances are formed as part of an electrical charge transfer element.

5. An electronic musical instrument as claimed in claim 1, wherein said second group of electrical capacitances are formed as part of a bucket brigade device.

6. An electronic musical instrument as claimed in claim 1, further including variable impedance elements for discharging the electrical charge of said second group of electrical capacitances.

7. An electronic musical instrument as claimed in claim 1, further including variable impedance elements arranged to be sequentially switched over for connection with respect to said first group of electrical capacitances so that one of said variable impedance elements is commonly used for a plurality of the keys.

8. An electronic musical instrument as claimed in claim 1, wherein said first group of electrical capacitances and said second group of electrical capacitances are incorporated in individual circuits so as to be formed into integrated circuits of separate chips for combination thereof to constitute said electronic musical instrument.

* * * * *